US011067928B2

(12) United States Patent
Inagaki et al.

(10) Patent No.: US 11,067,928 B2
(45) **Date of Patent: *Jul. 20, 2021**

(54) FIXING MEMBER, FIXING UNIT, AND IMAGE FORMING APPARATUS

(71) Applicant: FUJIFILM Business Innovation Corp., Tokyo (JP)

(72) Inventors: Tomotake Inagaki, Kanagawa (JP); Yusuke Watanabe, Kanagawa (JP); Tomoko Suzuki, Kanagawa (JP); Hideaki Ohara, Kanagawa (JP); Ryohei Yoshikawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/750,199

(22) Filed: Jan. 23, 2020

(65) Prior Publication Data

US 2021/0088944 A1 Mar. 25, 2021

(30) Foreign Application Priority Data

Sep. 24, 2019 (JP) ..... JP2019-172756

(51) Int. Cl.
*G03G 15/20* (2006.01)

(52) U.S. Cl.
CPC ..... *G03G 15/206* (2013.01)

(58) Field of Classification Search
CPC ..... G03G 15/2057; G03G 15/2053; G03G 15/206
See application file for complete search history.

(56) References Cited

U.S. PATENT DOCUMENTS

2002/0146259 A1 10/2002 Zhou et al.
2005/0142351 A1* 6/2005 Takagi ..... G03G 15/2057 428/323
2014/0241771 A1* 8/2014 Endo ..... G03G 15/2057 399/333
2020/0326649 A1* 10/2020 Inagaki ..... G03G 15/2057

FOREIGN PATENT DOCUMENTS

JP 2002-258648 A 9/2002
JP 2004-309513 A 11/2004
JP 2012-168218 A 9/2012

* cited by examiner

*Primary Examiner* — Sandra Brase
(74) *Attorney, Agent, or Firm* — Sughrue Mion, PLLC

(57) ABSTRACT

A fixing member includes a substrate layer including a resin; a first metal layer that is provided on an outer peripheral surface of the substrate layer and including Cu; a second metal layer that is provided on the outer peripheral surface of the first metal layer so as to be in contact with the first metal layer, includes Ni, and has crystal orientation indexes of 0.80 to 1.30 for a (111) plane, 0.80 to 1.50 for a (200) plane, and 0.70 to 1.30 for a (311) plane; and an elastic layer that is provided on an outer peripheral surface of the second metal layer.

11 Claims, 3 Drawing Sheets

FIXING MEMBER, FIXING UNIT, AND IMAGE FORMING APPARATUS

CROSS-REFERENCE TO RELATED APPLICATIONS

This application is based on and claims priority under 35 USC 119 from Japanese Patent Application No. 2019-172756 filed Sep. 24, 2019.

BACKGROUND

(i) Technical Field

The present invention relates to a fixing member, a fixing unit, and an image forming apparatus.

(ii) Related Art

JP-A-2002-258648 discloses that "a fixing belt having at least a release layer and a nickel electroformed metal layer, wherein the nickel electroforming provides a crystal orientation exhibiting a predominant growth of the (200) plane, with a crystal orientation ratio of I (200)/I (111) being 3 or more, and the fixing belt has a micro Vickers hardness of 280 to 450".

JP-A-2004-309513 discloses that "a fixing belt having at least a release layer and a metal layer provided on the release layer, in which the metal layer has nickel and at least one selected from the group consisting of a structure and a grain size of a crystal that forms the metal layer, and crystal plane orientation is varied in the film thickness direction".

JP-A-2012-168218 discloses that "a sleeve-shaped metal belt made of a nickel alloy, which has a crystal orientation exhibiting a predominant growth of the (200) plane, with a crystal orientation ratio of (200/111) being 1.00 or more, in which the nickel alloy contains an element other than nickel, the element satisfying conditions: an atomic radius is 1.16 to 1.47 Å, electronegativity is 1.5 to 1.9, and thermal conductivity is 150 W/m·K or more.

SUMMARY

In the electromagnetic induction heating type fixing unit, for example, a fixing member having a substrate layer including a resin, a metal layer, and an elastic layer is used, and the metal layer is heated by the electromagnetic induction device. A recording medium having an unfixed toner image formed on the surface is sandwiched between the heated fixing member and a pressurizing member to fix the toner image on the recording medium.

In the electromagnetic induction heating type fixing unit, in view of energy saving or the like, it is preferable that the time (hereinafter also referred to as "warming-up operation time") after heating by the electromagnetic induction device is started until the fixing member reaches a target temperature is shortened.

Furthermore, in a case where a fixing member having a substrate layer including a resin, a metal layer, and an elastic layer is used in a fixing unit of an image forming apparatus for a long period of time, the fixing member is stressed and repeatedly bent, so that the metal layer may cause cracking.

Aspects of non-limiting embodiments of the present disclosure relate to provide a fixing member having a substrate layer, a first metal layer, a second metal layer, and an elastic layer, which satisfies both shortening warming-up operation time and preventing cracking of the second metal layer due to repeated bending, as compared with a case where the second metal layer has a crystal orientation index of less than 0.80 or more than 1.30 for a (111) plane, a crystal orientation index of less than 0.80 or more than 1.50 for a (200) plane, or a crystal orientation index of less than 0.70 or more than 1.30 for a (311) plane.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a fixing member including:

a substrate layer including a resin;

a first metal layer that is provided on an outer peripheral surface of the substrate layer and includes Cu;

a second metal layer that is provided on the outer peripheral surface of the first metal layer so as to be in contact with the first metal layer, includes Ni, and has crystal orientation indexes of 0.80 to 1.30 for a (111) plane, 0.80 to 1.50 for a (200) plane, and 0.70 to 1.30 for a (311) plane; and an elastic layer that is provided on an outer peripheral surface of the second metal layer.

BRIEF DESCRIPTION OF THE DRAWINGS

Exemplary embodiments of the present invention will be described in detail based on the following figures, wherein.

DETAILED DESCRIPTION

Figure 1:
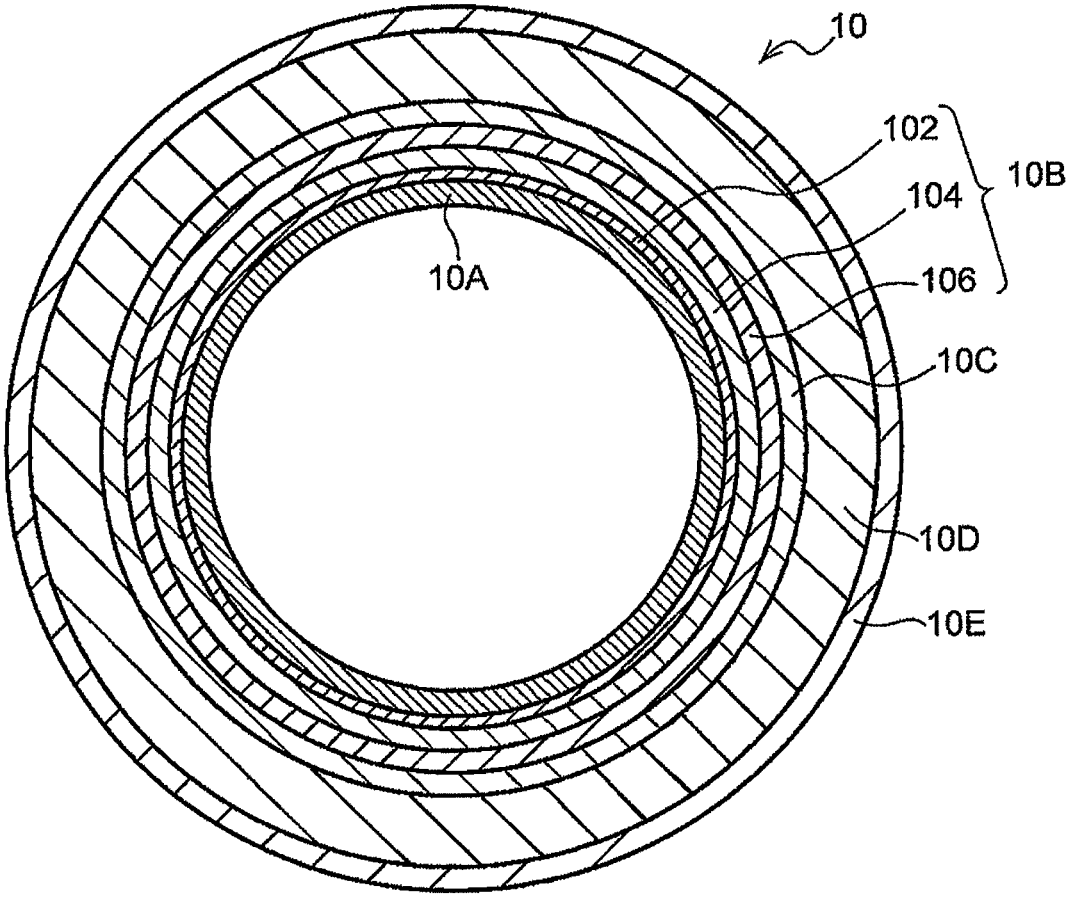
FIG. 1 is a schematic cross-sectional view illustrating a layer configuration in an example of a fixing member according to an exemplary embodiment.

An exemplary embodiment that is an example of the present invention is described below.

[Fixing Member]

The fixing member according to the exemplary embodiment includes a substrate layer including a resin, a first metal layer that is provided on an outer peripheral surface of the substrate layer and includes Cu, a second metal layer that is provided on the outer peripheral surface of the first metal layer so as to be in contact with the first metal layer, includes Ni, and has crystal orientation indexes of 0.80 to 1.30 for a (111) plane, 0.80 to 1.50 for a (200) plane, and 0.70 to 1.30 for a (311) plane, and an elastic layer that is provided on an outer peripheral surface of the second metal layer.

In the electromagnetic induction heating type fixing unit, for example, a fixing member having a substrate layer including a resin, a metal layer, and an elastic layer is used, and the metal layer is heated by the electromagnetic induction device. A recording medium having an unfixed toner image formed on the surface is sandwiched between the heated fixing member and a pressuring member to fix the toner image on the recording medium.

In the electromagnetic induction heating type fixing unit, it takes not so short time after heating by the electromagnetic induction device is started until the fixing member reaches a target temperature, and in view of energy saving or the like, it is desired that this warm-up operation time is shortened.

The fixing member having the substrate layer including a resin, the metal layer, and the elastic layer is stressed and repeatedly bent while the outer circumferential surface is subjected to pressurization and rotation by a pressurizing member provided in the fixing unit. Particularly, in a case where the fixing member constitutes an endless belt and the curvature periodically varies as the fixing member moves along the outer circumferential surface of the pressurizing member in the contact area with the pressurizing member, it is considered that the load on the metal layer due to the repetition of bending is increased. In a case where the fixing member is used for a long time in the fixing unit of the image forming apparatus, the second metal layer may be cracked due to repeated bending.

With respect to this, in the fixing member according to the exemplary embodiment, by setting the crystal orientation indexes of the specific crystal planes of the second metal layer including Ni within the respective ranges described above, cracking of the second metal layer due to repeated bending is prevented, and warming-up operation time is shortened. Therefore, it is considered that in the fixing member according to the exemplary embodiment, since the cracking of the second metal layer due to repeated bending is prevented, durability is high, and since the time constant is decreased, the slow heating time, as well as the warming-up operation time, is also shortened, and as a result, energy-saving properties are excellent.

Here, for obtaining the crystal orientation index of a specific crystal plane regarding each metal layer, crystal structure analysis is performed by using an X-ray diffractometer (for example, Smart Lab, manufactured by Rigaku Corporation), the integrated intensity of the crystal spectrum is obtained, and the Willson & Rogers Method is applied thereto to calculate a crystal orientation index.

Specifically, first, the X-ray diffractometer (source: CuKα, voltage: 40 kV, current: 40 mA) is used, to obtain an X-ray diffraction spectrum (hereinafter also referred to as "metal layer XRD") of the metal layer to be measured. Meanwhile, a spectrum of powder X-ray diffraction (hereinafter also referred to as "powder XRD") of the same material as the metal layer to be measured is obtained from measurements or literature.

In a case where the peak integrated intensity of a specific crystal plane in the metal layer XRD is $I_A$, the total peak integrated intensity of all crystal planes in the metal layer XRD is IT, the peak integrated intensity of the specific crystal plane in the powder XRD is $P_A$, and the total peak integrated intensity of all crystal planes in the powder XRD is $P_T$, the crystal orientation index NA for the specific crystal plane is obtained by the following expression.

$$N_A=(I_A/I_T)/(P_A/P_T) \quad \text{Expression:}$$

In a case where the metal layer XRD is obtained for the second metal layer of the fixing member, for example, a spectrum including a peak derived from the second metal layer may be obtained by performing measurement by an X-ray diffractometer on the second metal layer exposed by peeling off the elastic layer and analyzing the resulting spectrum.

In a case where the metal layer XRD is obtained for the first metal layer in the fixing member, for example, a spectrum including a peak derived from the first metal layer may be obtained by performing the measurement with an X-ray diffractometer in the state where the elastic layer is peeled off and the second metal layer is provided and analyzing the resulting spectrum.

Examples of the fixing member according to the exemplary embodiment include an endless belt-shaped tubular body (hereinafter also simply referred to as "endless belt").

Hereinafter, as an example of the fixing member according to the exemplary embodiment, a configuration of an endless belt is described with reference to the drawings.

FIG. 1 is a schematic configuration diagram illustrating an example of an endless belt.

A belt 10 illustrated in FIG. 1 is an endless belt having a layer configuration in which a metal layer 10B, an adhesive layer 10C, an elastic layer 10D, and the release layer 10E are sequentially laminated on an outer circumferential surface of a substrate 10A that is the substrate layer including a resin. The adhesive layer 10C and the release layer 10E are layers that are provided, if necessary.

On the metal layer 10B, an underlaying metal layer 102, an electromagnetic induction metal layer 104 that is the first metal layer including Cu, and a metal protective layer 106 that is the second metal layer including Ni are sequentially laminated. The underlaying metal layer 102 is a layer that is provided, if necessary. The electromagnetic induction metal layer 104 is a layer that self-heats due to electromagnetic induction in a case where a belt 10 is used in an electromagnetic induction type fixing unit.

As an endless belt according to the exemplary embodiment, the belt 10 having the configuration illustrated in FIG. 1 is described below as an example, but, the exemplary embodiment is not limited to the present structure, and may have other layers.

In the following description, the reference numerals of each layer may be omitted.

Substrate 10A

The substrate 10A is not particularly limited as long as the substrate is a layer including at least a resin.

In a case where the belt 10 is used in an electromagnetic induction type fixing unit, the substrate 10A is preferably a layer that has little change in physical properties and maintains high strength even in a case where the metal layer 10B generates heat. Therefore, it is preferable that the substrate 10A is mainly formed of a heat resistant resin (in the present specification, "mainly" and a "main component" mean that a weight ratio is 50% or more, and the same is applied to the followings).

Examples of the resin that may form the substrate 10A include heat resistant resins with high heat resistant and high strength, such as liquid crystal materials such as polyimide, aromatic polyamide, and thermotropic liquid crystal polymer. In addition to these, polyester, polyethylene terephthalate, polyether sulfone, polyether ketone, polysulfone, polyimide amide, and the like are used. Among these, polyimide is preferable.

The heat insulation effect may be further improved by adding a filler with a heat insulation effect to the resin or foaming a resin.

For example, the content of the resin with respect to the entire substrate 10A is 50 weight % or more, preferably 60 weight % or more, more preferably 70 weight % or more, further preferably 78 weight % or more, and still further preferably 90 weight % or more.

In view of achieving both rigidity and flexibility for realizing repeated driving transportation of the belt for a long period of time, the thickness of the substrate 10A is preferably from 10 μm to 200 μm, more preferably from 30 μm to 100 μm, even more preferably from 50 μm to 90 μm.

In view of preventing the cracking of the electromagnetic induction metal layer 104 which may be caused by repeated bending, the thickness (that is, the thickness of the substrate 10A/the thickness of the electromagnetic induction metal layer 104) of the substrate 10A with respect to the thickness of the electromagnetic induction metal layer 104 is preferably 1.7 to 18, more preferably 3.0 to 13, and even more preferably 3.4 to 12.

In view of preventing the cracking of the metal layer 10B, the tensile strength of the substrate 10A preferably satisfies 200 MPa or more (more preferably 250 MPa or more). The tensile strength of a substrate is adjusted with a kind of a resin, a kind of a filler, or an addition amount thereof.

The tensile strength (MPa) of the substrate is measured in terms of tensile breaking strength (MPa) in a case where the substrate is cut into a strip having a width of 5 mm, the strip is installed in a tensile tester Model 1605N (manufactured by Aikoh Engineering Co., Ltd.), and subjected to pulling at a constant speed of 10 mm/sec.

The outer circumferential surface of the substrate 10A may be subjected to a treatment (surface roughening treatment) for roughening the surface roughness in advance in order that metal grains easily attach to the substrate on forming the underlaying metal layer 102. Examples of the surface roughening treatment include sand blasting using alumina abrasive grains or the like, cutting, and sandpaper polishing.

Underlaying Metal Layer 102

The underlaying metal layer 102 is a layer formed in advance in order to form the electromagnetic induction metal layer 104 on the outer circumferential surface of the substrate 10A by an electrolytic plating method and is provided, if necessary. As a method for forming the electromagnetic induction metal layer 104, in view of cost and the like, an electrolytic plating method is preferable, but in a case where the substrate 10A mainly formed of a resin is used, it is difficult to perform the direct electrolytic plating. Therefore, it is preferable to provide the underlaying metal layer 102 in order to form the electromagnetic induction metal layer 104.

Examples of the method of forming the underlaying metal layer 102 on the outer circumferential surface of the substrate 10A include an electroless plating method, a sputtering method, and a vapor deposition method, and in view of ease of film formation, a chemical plating method (electroless plating method) is preferable.

Examples of the underlaying metal layer 102 include an electroless nickel plating layer and an electroless copper plating layer. The "nickel plating layer" means a plating layer including Ni (such as a nickel layer and a nickel alloy layer), and the "copper plating layer" means a plating layer including Cu (such as a copper layer and a copper alloy layer).

The thickness of the underlaying metal layer 102 is preferably from 0.1 μm to 5 μm and more preferably from 0.3 μm to 3 μm.

The thickness of each layer constituting the belt according to the exemplary embodiment is a value obtained by preparing a cross section in a circumferential direction and an axial direction of the cylindrical body of the belt and measuring the film thickness from an observed image at the acceleration voltage of 2.0 kV and 5,000 times of a scanning electron microscope ("JSM6700F" manufactured by JEOL Ltd.).

Electromagnetic Induction Metal Layer 104

The electromagnetic induction metal layer 104 is not particularly limited as long as the electromagnetic induction metal layer is a layer including at least Cu. In a case where the belt 10 is used in an electromagnetic induction type fixing unit, the electromagnetic induction metal layer 104 becomes a heat generating layer having a function of generating heat due to an eddy current generated in this layer in a case where a magnetic field is applied.

In addition to Cu, the electromagnetic induction metal layer 104 may include, for example, metal that generates an electromagnetic induction effect other than Cu, such as nickel, iron, gold, silver, aluminum, chromium, tin, and zinc. However, the electromagnetic induction metal layer 104 is preferably a layer of copper or an alloy including copper as a main component, and the content of Cu with respect to the entire electromagnetic induction metal layer 104 is, for example, 80 weight % or more, preferably 90 weight % or more, and more preferably 95 weight % or more.

The electromagnetic induction metal layer 104 is formed by a known method, for example, an electrolytic plating method.

In a case where the electromagnetic induction metal layer 104 is formed by an electrolytic plating method, for example, a plating solution including copper ions is prepared, and the substrate 10A provided with the underlaying metal layer 102 is immersed in this plating solution to perform electrolytic plating. The plating solution may include a brightener. By adding a brightener to the plating solution, the crystal structure of the electromagnetic induction metal layer 104 may be easily controlled.

Examples of the brightener added to the plating solution for forming the electromagnetic induction metal layer 104 include KOTAC1 and KOTAC2 (above, manufactured by Daiwa Special Chemical Co., Ltd.), and ELECOPPER-25MU, ELECOPPER-25A, and TOP LUCINA SF (above, manufactured by Okuno Chemical Industries Co., Ltd.).

It is preferable that the crystal orientation indexes of the specific crystal planes of the electromagnetic induction metal layer 104 are 1.10 to 1.40 for the (111) plane, 0.20 to 1.70 for the (200) plane, and 0.30 to 1.50 for the (311) plane. In addition, it is more preferable that the crystal orientation indexes of the specific crystal planes of the electromagnetic induction metal layer 104 are 1.10 to 1.25 for the (111) plane, 0.50 to 1.20 for the (200) plane, and 0.80 to 1.30 for the (311) plane.

When the crystal orientation indexes of the specific crystal planes of the electromagnetic induction metal layer 104 are within the respective ranges described above, and the crystal orientation indexes of the specific crystal planes of the metal protective layer 106 are 0.80 to 1.30 for the (111) plane, 0.80 to 1.50 for the (200) plane, and 0.70 to 1.30 for the (311) plane, both of shortening of the warming-up operation time of the fixing unit and preventing the cracking of the second metal layer due to repeated bending are exhibited.

In a case where the electromagnetic induction metal layer 104 is formed by an electrolytic plating method, the crystal orientation index of each crystal plane of the electromagnetic induction metal layer 104 is controlled by adjusting an addition amount of a brightening agent added to a plating solution (that is, content of brightening agent with respect to the whole plating solution), a temperature of electrolytic plating solution at the time of electrolytic plating treatment, and a plating current density.

From a viewpoint of shortening of the warming-up operation time of the fixing unit and preventing the cracking of the metal layer due to repeated bending, an average crystal grain size of the electromagnetic induction metal layer 104 is preferably 0.10 μm to 3.10 μm and more preferably 1.10 μm to 1.90 μm.

In a case where the electromagnetic induction metal layer 104 is formed by electrolytic plating treatment, for example, the average crystal grain size of the electromagnetic induction metal layer 104 is controlled by adjusting the addition amount of the brightening agent added to the electrolytic plating solution (that is, content of brightening agent with respect to the whole electrolytic plating solution), the temperature of the electrolytic plating solution at the time of electrolytic plating treatment, and the plating current density.

Here, the average crystal grain size in each metal layer is obtained as follows.

First, the metal layer of a measurement target is cut in a direction perpendicular to the outer peripheral surface to obtain a section. The obtained section is observed by a scanning electron microscope (Gemini SEM 450 manufactured by Zeiss Corporation) to obtain a section image. The obtained section image is analyzed with an image processing software (ImageJ) to extract crystal grains, a maximum grain size of each of the extracted crystal grains is measured, and the number average value thereof is set as an "average crystal grain size".

In view of efficiently generating heat in a case where the belt 10 is used in an electromagnetic induction type fixing unit, the thickness of the electromagnetic induction metal layer 104 is preferably from 3 μm to 50 μm, more preferably from 3 μm to 30 μm, and even more preferably from 5 μm to 20 μm.

Metal Protective Layer 106

The metal protective layer 106 is a metal layer that is provided so as to be in contact with the electromagnetic induction metal layer 104 and includes Ni.

The metal protective layer 106 improves the film hardness of the metal layer 10B, prevents cracking due to repeated deformation, oxidation deterioration due to repeated heating for a long period of time, and the like, and maintains heat generation characteristics. The metal protective layer 106 includes at least Ni and may include other metals, if necessary. However, the metal protective layer 106 is preferably a layer of nickel or an alloy including nickel as a main component, and the content of Ni with respect to the entire metal protective layer 106 is, for example, 80 weight % or more, preferably 90 weight %, and more preferably 95 weight % or more.

In consideration of workability with a thin film, the metal protective layer 106 is preferably formed by an electrolytic plating method.

In a case where the metal protective layer 106 is formed by an electrolytic plating method, for example, a plating solution including nickel ions is prepared, and the substrate 10A provided with the underlaying metal layer 102 and the electromagnetic induction metal layer 104 is immersed in this plating solution to form an electrolytic plating layer having a required thickness. The plating solution may include a brightener. By adding a brightener to the plating solution, the crystal structure of the metal protective layer 106 may be easily controlled.

Examples of brighteners to be added to the plating solution for forming the metal protective layer 106 include TOP SELENA 95X, SUPER NEOLITE, SUPER ZENER, MONOLITE, TOP LUNAR, TOP LEONA NL, ACNA B-30, ACNA B, and TURBO LIGHT (above, manufactured by Okuno Chemical Industries Co., Ltd.), and #810, #81, #83, and #81-J (above, manufactured by JCU Corporation).

The crystal orientation indexes of the specific crystal planes of the metal protective layer 106 are 0.80 to 1.30 for the (111) plane, 0.80 to 1.50 for the (200) plane, and 0.70 to 1.30 for the (311) plane. In addition, it is more preferable that the crystal orientation indexes of the specific crystal planes of the metal protective layer 106 are 1.00 to 1.30 for the (111) plane, 1.00 to 1.40 for the (200) plane, and 0.80 or more and less than 1.10 for the (311) plane.

By setting the crystal orientation index of each crystal plane of the metal protective layer 106 within the prescribed range, both of shortening of the warming-up operation time of the fixing unit and preventing the cracking of the second metal layer due to repeated bending are exhibited.

In a case where the metal protective layer 106 is formed by an electrolytic plating method, the crystal orientation index of each crystal plane in the metal protective layer 106 is controlled by adjusting an addition amount of a brightening agent added to a plating solution (that is, content of brightening agent with respect to the whole plating solution), a temperature of electrolytic plating solution at the time of electrolytic plating treatment, and a plating current density.

It is preferable that ratios (Ni/Cu) of the crystal orientation index (Ni) of the metal protective layer 106 to the crystal orientation index (Cu) of the electromagnetic induction metal layer 104 with respect to the same crystal plane are 0.57 to 1.18 for the (111) plane, 0.47 to 7.50 for the (200) plane, and 0.47 to less than 4.33 for the (311) plane.

In addition, it is more preferable that the ratios (Ni/Cu) of the crystal orientation index of the metal protective layer 106 to the crystal orientation index of the electromagnetic induction metal layer 104 with respect to the same crystal plane are 0.80 to 1.18 for the (111) plane, 0.83 to 2.80 for the (200) plane, and 0.62 or more and less than 1.38 for the (311) plane.

Among these, it is further more preferable that the ratios (Ni/Cu) of the crystal orientation index of the metal protective layer 106 to the crystal orientation index of the electromagnetic induction metal layer 104 with respect to the same crystal plane are 0.85 to 1.10 for the (111) plane, 0.90 to 2.50 for the (200) plane, and 0.70 or more and less than 1.30 for the (311) plane.

By setting the ratios (Ni/Cu) with respect to the respective specific crystal planes within the respective ranges described above, both of shortening of the warming-up operation time of the fixing unit and preventing the cracking of the second metal layer due to repeated bending are exhibited.

An average crystal grain size of the metal protective layer 106 is 0.15 μm to 0.19 μm, and is preferably 0.16 μm to 0.18 μm.

When the average crystal grain size of the metal protective layer 106 is within the range, the cracking of the metal protective layer 106 is prevented, and as a result, the cracking of the whole metal layer 10B due to repeated bending is prevented and the warming-up operation time of the fixing unit is shortened.

In a case where the metal protective layer 106 is formed by an electrolytic plating method, the average crystal grain size of the metal protective layer 106 is controlled by adjusting an addition amount of a brightening agent added to an electrolytic plating solution (that is, content of brightening agent with respect to the whole plating solution), a temperature of the electrolytic plating solution at the time of electrolytic plating treatment, and a plating current density.

The ratio (Ni/Cu) of the average crystal grain size of the metal protective layer 106 to the average crystal grain size of the electromagnetic induction metal layer 104 is preferably 0.05 to 1.90, more preferably 0.05 to 1.80, and further more preferably 0.08 to 1.80.

By setting the ratio (Ni/Cu) within the range, both of shortening of the warming-up operation time of the fixing unit and preventing the cracking of the second metal layer due to repeated bending are further exhibited.

In view of preventing the cracking due to repeated bending, obtaining flexibility, preventing the heat capacity of the film itself from becoming too large, and shortening the warm-up time, the thickness of the metal protective layer 106 is preferably from 2 μm to 30 μm, more preferably from 5 μm to 30 μm, even more preferably from 5 μm to 20 μm, and particularly preferably from 5 μm to 15 μm.

An Adhesive Layer 10C

In view of improving the adhesiveness between the layer constituting the outer circumferential surface of the metal layer 10B (the metal protective layer 106 in FIG. 1) and the elastic layer 10D, the adhesive layer 10C may be sandwiched therebetween, if necessary.

In view of thermal conductivity, the adhesive layer 10C is generally provided as a thin film layer (for example, 1 μm or less). In view of ease of forming the adhesive layer, the thickness of the adhesive layer 10C is preferably from 0.1 μm to 1 μm and more preferably from 0.2 μm to 0.5 μm.

As the adhesive used for the adhesive layer 10C, an adhesive that has little change in physical properties even in a case where the adjacent metal layer 10B generates heat and has excellent heat transfer to the outer circumferential surface side is preferable. Specific examples include a silane coupling agent-based adhesive, a silicone-based adhesive, an epoxy resin-based adhesive, and a urethane resin-based adhesive.

A known method may be applied to form the adhesive layer 10C, and for example, an adhesive layer-forming coating solution may be formed on the metal layer 10B by a coating method. The adhesive layer-forming coating solution may be prepared by a known method, and for example, the adhesive layer-forming solvent may be prepared by mixing and stirring an adhesive and a solvent, if necessary.

Specifically, for example, first, the adhesive layer-forming coating solution is applied (for example, applied by a flow coating method (spiral winding coating)) to the metal layer 10B, if necessary, followed by drying and heating, to thereby form an adhesive film. The drying temperature in the drying, for example, is from 10° C. to 35° C., and the drying time, for example, is from 10 minutes to 360 minutes. The heating temperature in the heating is a range of 100° C. to 200° C., and the heating time includes, for example, 10 minutes to 360 minutes. The heating may be performed in an inert gas (for example, nitrogen gas and argon gas) atmosphere.

Elastic Layer 10D

The elastic layer 10D is not particularly limited as long as the elastic layer has elastic properties.

The elastic layer 10D is a layer provided in view of providing elastic properties to the pressure applied to the fixing member from the outer circumferential side, and for example, in a case where the elastic layer is used as a fixing belt in an image forming apparatus, the elastic layer has a function of causing the surface of the fixing member to follow the unevenness of a toner image on the recording medium and to closely attach to the toner image.

For example, the elastic layer 10D may be formed of an elastic material that is capable of being restored to an original shape thereof even after being deformed with an external force of 100 Pa.

Examples of the elastic material used for the elastic layer 10D include a fluorine resin, a silicone resin, a silicone rubber, a fluororubber, and a fluorosilicone rubber. As the material of the elastic layer, in view of heat resistance, thermal conductivity, insulation, and the like, silicone rubber and fluororubber are preferable, and silicone rubber is more preferable.

Examples of the silicone rubber include RTV silicone rubber, HTV silicone rubber, and liquid silicone rubber, and specific examples thereof include polydimethyl silicone rubber (MQ), methyl vinyl silicone rubber (VMQ), methyl phenyl silicone rubber (PMQ), and fluorosilicone rubber (FVMQ).

Examples of a commercially available product of the silicone rubber include liquid silicone rubber SE6744 manufactured by Dow Corning.

As the silicone rubber, silicone rubber mainly having an addition reaction type crosslinked form is preferable. The silicone rubbers having various types of functional groups are known, and dimethyl silicone rubber having a methyl group, methyl phenyl silicone rubber having a methyl group and a phenyl group, vinyl silicone rubber having a vinyl group (vinyl group-containing silicone rubber), and the like are preferable. A vinyl silicone rubber having a vinyl group is more preferable, and further, silicone rubber having an organopolysiloxane structure having a vinyl group and a hydrogen organopolysiloxane structure having a hydrogen atom (SiH) bonded to a silicon atom is preferable.

Examples of the fluororubber include vinylidene fluoride-based rubber, tetrafluoroethylene/propylene-based rubber, tetrafluoroethylene/perfluoromethyl vinyl ether rubber, phosphazene-based rubber, and fluoropolyether.

Examples of a commercially available product of the fluororubber include VITON B-202 manufactured by DuPont Dow elastmers.

As the elastic material used for the elastic layer 10D, a material including silicone rubber as a main component (that is, including 50% or more by weight ratio) is preferable, and the content thereof is more preferably 90 weight % or more and even more preferably 99 weight % or more.

In addition to the elastic material, the elastic layer 10D may include an inorganic filler for the purpose of reinforcement, heat resistance, heat transfer, and the like. Examples of the inorganic filler include known fillers, and preferable examples thereof include fumed silica, crystalline silica, iron oxide, alumina, and metallic silicon.

In addition to the above, examples of the materials of the inorganic filler include known mineral fillers such as carbide (for example, carbon black, carbon fiber, and carbon nanotube), titanium oxide, silicon carbide, talc, mica, kaolin, calcium carbonate, calcium silicate, magnesium oxide, graphite, silicon nitride, boron nitride, cerium oxide, and magnesium carbonate.

Among these, in view of thermal conductivity, silicon nitride, silicon carbide, graphite, boron nitride, and carbide are preferable.

The content of the inorganic filler in the elastic layer 10D may be determined depending on the required thermal conductivity, mechanical strength, and the like, and the content is, for example, from 1 weight % to 20 weight %, preferably from 3 weight % to 15 weight %, and more preferably from 5 weight % to 10 weight %.

The elastic layer 10D may include, as additives, for example, a softening agent (such as paraffin-based softening agent), a processing aid (such as stearic acid), an anti-aging agent (such as amine-based anti-aging agent), and a vulcanizing agent (sulfur, metal oxides, peroxide, or the like), and a functional filler (alumina, and the like).

The thickness of the elastic layer 10D is, for example, from 30 μm to 600 μm and preferably from 100 μm to 500 μm.

The elastic layer 10D may be formed by applying a known method, and for example, the elastic layer 10D may be formed on the adhesive layer 10C by a coating method.

In a case where silicone rubber is used as the elastic material of the elastic layer 10D, for example, first, an elastic layer-forming coating solution including liquid silicone rubber that is cured by heating to become silicone rubber is prepared. Next, an elastic layer-forming coating solution is applied (for example, applied by a flow coating method (spiral winding coating)) to the adhesive film formed by applying and drying the adhesive layer-forming composition to form an elastic coating film, and if necessary, the elastic coating film may be vulcanized, thus forming an elastic layer on the adhesive layer. The vulcanization temperature in vulcanization is, for example, from 150° C. to 250° C., and the vulcanization time is, for example, 30 minutes to 120 minutes.

Release Layer 10E

The release layer 10E is a layer that has a function of preventing a toner image being in a molten state from adhering onto the surface (outer circumferential surface) on the side in contact with the recording medium in fixing. The release layer is provided, if necessary.

The release layer 10E, for example, requires heat resistance and releasibility. In this viewpoint, it is preferable to use a heat resistant release material as the material constituting the release layer, and specific examples thereof include a fluororubber, a fluorine resin, a silicone resin, and a polyimide resin.

Among these, a fluorine resin is preferable as the heat resistant release material.

Specific examples of the fluorine resin include a tetrafluoroethylene-perfluoroalkyl vinyl ether copolymer (PFA), polytetrafluoroethylene (PTFE), a tetrafluoroethylene-hexafluoropropylene copolymer (FEP), and a polyethylene-tetrafluoro ethylene copolymer (ETFE), polyvinylidene fluoride (PVDF), polychloroethylene trifluoride (PCTFE), and vinyl fluoride (PVF).

A surface treatment may be performed on the surface of the release layer on the elastic layer side. The surface treatment may be a wet treatment or a dry treatment, and examples thereof include a liquid ammonia treatment, an excimer laser treatment, and a plasma treatment.

The thickness of the release layer 10E is preferably from 10 μm to 100 μm and more preferably from 20 μm to 50 μm.

The release layer 10E may be formed by applying a known method, and for example, may be formed by a coating method.

The release layer 10E may be formed by, for example, preparing a tube-like release layer in advance, forming an adhesive layer, for example, on the inner surface of the tube, and then covering the outer periphery of the elastic layer 10D.

Application

The belt 10, for example, is preferably used in an image forming apparatus. Specifically, the belt is used as a fixing belt, a pressure belt, or the like used in an electromagnetic induction heating type fixing unit that fixes an unfixed toner image formed on a recording medium.

Fixing Unit

The fixing unit according to the exemplary embodiment has the fixing member according to the exemplary embodiment, a pressurizing member that applies pressure to an outer circumferential surface of the fixing member and sandwiches a recording medium having an unfixed toner image formed on the surface between the pressurizing member and the fixing member, and an electromagnetic induction device that causes the metal layer (specifically, the first metal layer) included in the fixing member to generate heat by electromagnetic induction.

Hereinafter, as an example of the fixing unit according to the exemplary embodiment, an aspect to which the endless belt (that is, the belt 10) is applied as a fixing member is described, but the present invention is not limited thereto.

Figure 2:
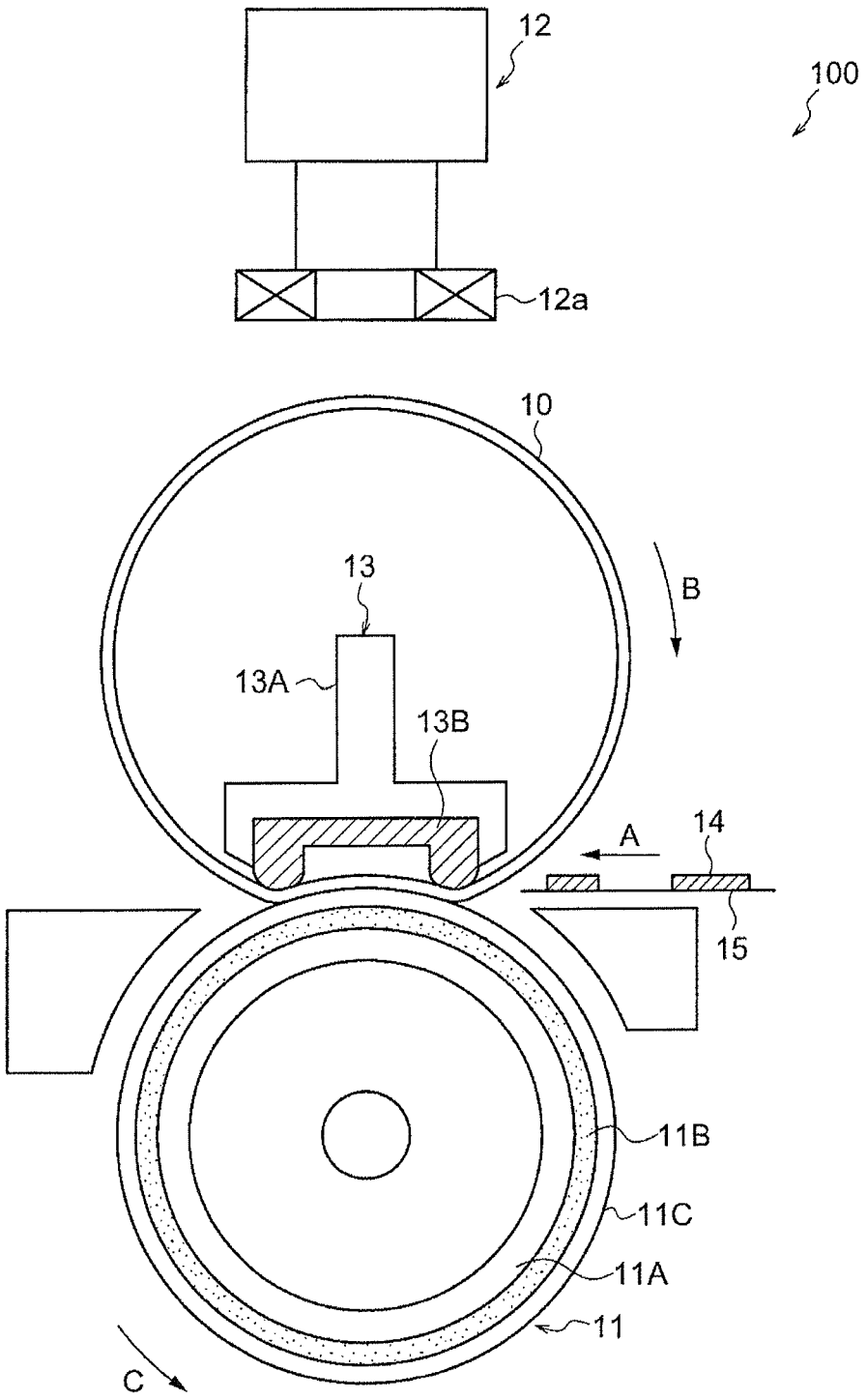
FIG. 2 is a schematic configuration diagram illustrating an example of a fixing unit according to the exemplary embodiment.

FIG. 2 is a schematic configuration diagram illustrating an example of the fixing unit according to the exemplary embodiment.

The fixing unit 100 according to the exemplary embodiment is an electromagnetic induction type fixing unit including the belt 10 according to the exemplary embodiment. As shown in FIG. 2, a pressure roll (pressurizing member) 11 is arranged so as to apply pressure to a part of the belt 10, a contact area (nip) is formed between the belt 10 and the pressure roll 11 in view of efficiently performing fixing, and the belt 10 is curved along the circumferential surface of the pressure roll 11. In view of securing the peelability of the recording medium, a bending portion where the belt bends is formed at the end of the contact area (nip).

The pressure roll 11 has a configuration in which the elastic layer 11B is formed on a substrate 11A with silicone rubber or the like, and a release layer 11C is formed on the elastic layer 11B with a fluorine-based compound.

A facing member 13 is disposed inside the belt 10 at a position facing the pressure roll 11. The facing member 13 has a pad 13B that is made of metal, a heat resistant resin, heat resistant rubber, or the like, is in contact with the inner circumferential surface of the belt 10, and locally increases the pressure, and a support 13A that supports the pad 13B.

An electromagnetic induction heating unit 12 embedded with an electromagnetic induction coil (exciting coil) 12*a* is installed at a position facing the pressure roll 11 (an example of a pressurizing member) with the belt 10 as the center. The electromagnetic induction heating unit (electromagnetic induction unit) 12 applies an alternating current to the electromagnetic induction coil to change the generated magnetic field by an excitation circuit, and generates an eddy current in the metal layer 10B (especially, the electromagnetic induction metal layer 104 in the belt according to the exemplary embodiment illustrated in FIG. 1) of the belt 10. The eddy current is converted into heat (Joule heat) by the electric resistance of the metal layer 10B, and as a result, the surface of the belt 10 generates heat.

The position of the electromagnetic induction heating unit 12 is not limited to the position illustrated in FIG. 2, and for example, the electromagnetic induction heating unit may be installed on the upstream side in the rotational direction B with respect to the contact area of the belt 10, or may be installed on the inner side of the belt 10.

In the fixing unit 100 according to the exemplary embodiment, the driving force is transmitted by a driving unit to a gear fixed to an end portion of the belt 10, the belt 10 self-rotates in the direction of an arrow B, and the pressure roll 11 rotates in the reverse direction, that is, in the direction of an arrow C according to the rotation of the belt 10.

The recording medium 15 on which an unfixed toner image 14 is formed is passed through a contact area (nip) between the belt 10 and the pressure roll 11 in the fixing unit 100 in the direction of an arrow A, such that the unfixed toner image 14 in a molten state receives pressure to be fixed on the recording medium 15.

Image Forming Apparatus

An image forming apparatus according to the exemplary embodiment includes an image holding member, a charging unit that charges a surface of the image holding member, an electrostatic latent image forming unit that forms an electrostatic latent image on the charged surface of the image holding member, a developing unit that develops the electrostatic latent image formed on the surface of the image holding member by a toner to form a toner image, a transferring unit that transfers the toner image formed on the surface of the image holding member to a recording medium, and the fixing unit according to the exemplary embodiment that fixes the toner image on the recording medium.

Figure 3:
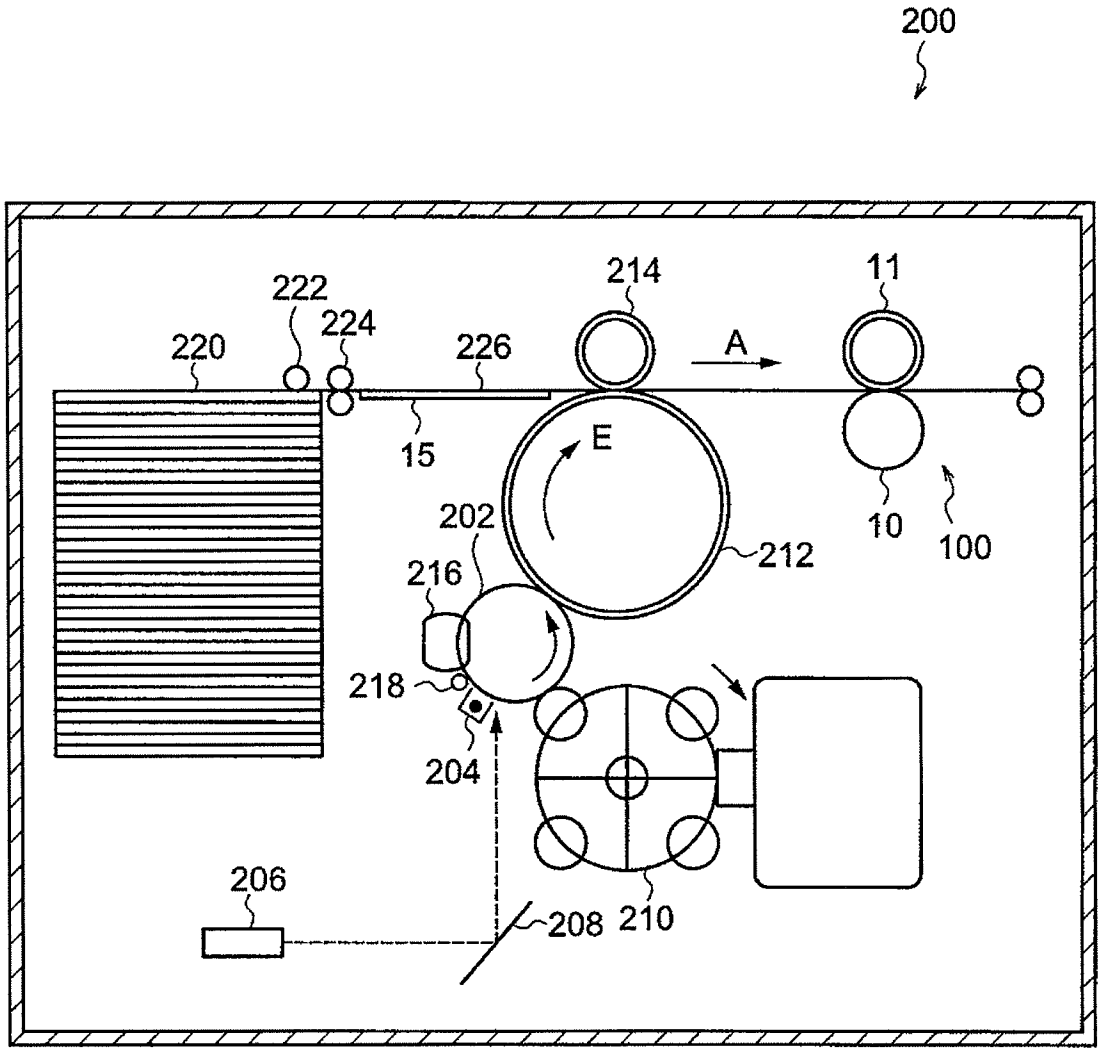
FIG. 3 is a schematic configuration diagram illustrating an example of an image forming apparatus according to the exemplary embodiment.

FIG. 3 is a schematic configuration diagram illustrating an example of the image forming apparatus according to the exemplary embodiment.

As illustrated in FIG. 3, an image forming apparatus 200 according to the exemplary embodiment includes a photoreceptor (an example of an image holding member) 202, a charging unit 204, a laser exposure unit (an example of a latent image forming apparatus) 206, a mirror 208, a developing unit 210, an intermediate transfer member 212, transfer roll (an example of a transferring unit) 214, a cleaning unit 216, an erasing unit 218, a fixing unit 100, and a paper feed unit (a paper feeding unit 220, a paper feed roller 222, an alignment roller 224, and a recording medium guide 226).

In a case where an image is formed by the image forming apparatus 200, first, a contactless type charging unit 204 provided near the photoreceptor 202 charges the surface of the photoreceptor 202.

The surface of the photoreceptor 202 charged by the charging unit 204 is irradiated with laser light corresponding to the image information (signal) of each color from the laser exposure unit 206 through the mirror 208 to form an electrostatic latent image.

The developing unit 210 forms a toner image by applying toner to the latent image formed on the surface of the photoreceptor 202. The developing unit 210 is provided with developing units (not shown) for respective colors respectively including toners of four colors of cyan, magenta, yellow, and black, and respective color toners are applied to the latent image formed on the surface of the photoreceptor 202 by the rotation of the developing unit 210 in the arrow direction, to form a toner image.

The toner images of the respective colors formed on the surface of the photoreceptor 202 are transferred onto the outer circumferential surface of the intermediate transfer member 212 in an overlapped manner at a contact section between the photoreceptor 202 and the intermediate transfer member 212 by a bias voltage applied between the photoreceptor 202 and the intermediate transfer member 212 according to the image information for each color toner image.

The intermediate transfer member 212 rotates in the direction of an arrow E with the outer circumferential surface thereof being in contact with the surface of the photoreceptor 202.

In addition to the photoreceptor 202, a transfer roll 214 is provided around the intermediate transfer member 212.

The intermediate transfer member 212 to which the multicolor toner image is transferred rotates in the direction of the arrow E. The toner image on the intermediate transfer member 212 is transferred to the surface of the recording medium 15 at the time of being transported in the direction of the arrow A to a contact section between the transfer roll 214 and the intermediate transfer member 212 by the paper feeder.

Paper feeding to the contact section between the intermediate transfer member 212 and the transfer roll 214 is performed by causing a recording medium stored in the paper feeding unit 220 to be pushed up to a position in contact with the paper feed roller 222 by recording medium pushing means (not shown) built in the paper feeding unit 220, and rotating the paper feed roller 222 and the alignment roller 224 at a point where the recording medium 15 is in contact with the roller 222 to transport the recording medium in the direction of the arrow A along the recording medium guide 226.

The toner image transferred to the surface of the recording medium 15 moves in the direction of the arrow A, and the toner image 14 is pressed against the surface of the recording medium 15 in a molten state in the contact area (nip) between the belt 10 and the pressure roll 11 and fixed on the surface of the recording medium 15. Thereby, an image fixed on the surface of the recording medium is formed.

The surface of the photoreceptor 202 after the toner image is transferred to the surface of the intermediate transfer member 212 is cleaned by the cleaning unit 216.

The surface of the photoreceptor 202 is cleaned by the cleaning unit 216 and then erased by the erasing unit 218.

EXAMPLES

Hereinafter, the present invention is described more specifically with reference to examples. However, the present invention is not limited to the following examples.

Example 1

Substrate 10A (Substrate Layer Including Resin)

A coating film is formed by applying a commercially available polyimide precursor solution (U VARNISH S, manufactured by Ube Industries, Ltd.) to the surface of a cylindrical stainless steel mold having an outer diameter of 30 mm by an immersion method. Next, this coating film is dried at 100° C. for 30 minutes to volatilize the solvent in the coating film, and then baked at 380° C. for 30 minutes to cause imidization, thereby forming a polyimide film having a film thickness of 60 μm. By peeling the polyimide film from the stainless steel surface, an endless belt-shaped heat resistant polyimide substrate having an inner diameter of 30 mm, a film thickness of 60 μm, and a length of 370 mm is obtained, and is designated as the substrate 10A (substrate layer including resin).

Underlaying Metal Layer 102

Next, an electroless nickel plating film having a film thickness of 0.3 μm is formed on the outer circumferential surface of the heat resistant polyimide substrate, and is designated as a underlaying metal layer 102.

<Electromagnetic Induction Metal Layer 104 (First Metal Layer)>

Using the electroless nickel plating film (underlying metal layer 102) as an electrode, a copper layer having a thickness of 10 μm is provided by the electrolytic plating method, and the copper layer is designated as the electromagnetic induction metal layer 104 (first metal layer).

The electrolytic plating solution used at the time of providing the copper layer is added with electric copper 25MU (manufactured by Okuno Chemical Industries Co., Ltd.) as a brightening agent, and the content of the brightening agent with respect to the whole electrolytic plating solution is 2 mL/L. In addition, the temperature of the electrolytic plating solution at the time of electrolytic plating treatment is 25° C., and the plating current density is 2 A/dm$^2$.

<Metal Protective Layer 106 (Second Metal Layer)>

Subsequently, a nickel layer having a thickness of 10 μm is provided on an outer peripheral surface of the obtained copper layer by the electrolytic plating method, and the layer is designated as a metal protective layer 106 (second metal layer).

An electrolytic plating solution used at the time of providing the nickel layer contains Top Selena 95X (manufactured by Okuno Chemical Industries Co., Ltd.) as a brightening agent, and the content of the brightening agent with respect to the whole electrolytic plating solution is 8.5 mL/L. In addition, in the electrolytic plating treatment, the temperature of the electrolytic plating solution is 50° C., and the plating current density is 6 A/dm$^2$.

<Elastic Layer 10D (Elastic Layer)>

Subsequently, a liquid silicone rubber (KE1940-35, liquid silicone rubber 35 degrees product, manufactured by Shin-Etsu Chemical Co., Ltd.) adjusted such that the hardness defined by HS type A is 35 degrees is applied on the outer peripheral surface of the obtained nickel layer (that is, second metal layer) to provide a film thickness of 200 μm, and dried to obtain an elastic layer 10D (elastic layer).

<Release Layer 10E>

Subsequently, a tetrafluoroethylene perfluoroalkyl vinyl ether copolymer (PFA) tube (thickness of 30 μm, including adhesion layer on inner surface) is applied thereon, and then subjected to adhesion baking (200° C., 2 hours).

In this manner, the elastic layer and the release layer are sequentially formed on the outer peripheral surface, and both end portions having a width of 5 mm of a release layer 10E are cut, thus forming a release layer 10E.

As described above, an endless belt-like fixing member 1 is obtained.

Example 2

An endless belt-like fixing member 2 is obtained in the same manner as in Example 1, except that the content of the brightening agent at the time of providing a nickel layer (second metal layer) by the electrolytic plating method is 9 mL/L, the temperature of the electrolytic plating solution is 45° C., and the plating current density is 5 A/dm$^2$.

Example 3

An endless belt-like fixing member 3 is obtained in the same manner as in Example 1, except that the content of the brightening agent at the time of providing a copper layer (first metal layer) by the electrolytic plating method is 1.5 mL/L, the temperature of the electrolytic plating solution is 30° C., and the plating current density is 1.5 A/dm$^2$.

Example 4

An endless belt-like fixing member 4 is obtained in the same manner as in Example 1, except that a film thickness of a heat resistant polyimide substrate is shown in Table 1.

Comparative Example 1

An endless belt-like fixing member C1 is obtained in the same manner as in Example 1, except that the content of the brightening agent at the time of providing a nickel layer (second metal layer) by the electrolytic plating method is 4 mL/L, the temperature of the electrolytic plating solution is 60° C., and the plating current density is 2 Å/dm$^2$.

Comparative Example 2

An endless belt-like fixing member C2 is obtained in the same manner as in Example 1, except that the content of the brightening agent at the time of providing a nickel layer (second metal layer) by the electrolytic plating method is 12 mL/L, the temperature of the electrolytic plating solution is 35° C., and the plating current density is 8 Å/dm$^2$.

Measurement

For the obtained fixing members, a crystal orientation index for each of the specific crystal planes and an average grain size with respect to the copper layer (first metal layer), and a crystal orientation index for each of the specific crystal planes and an average grain size with respect to the nickel layer (second metal layer) are measured by the above methods, and the results are shown in Table 1.

Evaluation (Energy Saving Performance Evaluation)

The obtained fixing member is installed in an image forming apparatus (ApeosPort-VI C3371 modified machine) in an environment of 22° C. and 55% RH. Subsequently, in a state where the fixing member is heated by electromagnetic induction in the image forming apparatus, the warm-up operation time (time after the power is turned on until the temperature reaches the set temperature of 180° C.) is evaluated. The results are shown in Table 1.

Evaluation (Bending Resistance Evaluation)

The bending resistance evaluation is performed by using a belt (hereinafter also referred to as a "plating belt") in which a heat resistant polyimide substrate (the substrate 10A) is provided with an electroless nickel plating film (underlaying metal layer 102), a copper layer (electromagnetic induction metal layer 104), and a nickel layer (metal protective layer 106) as in the production of the fixing members according to the examples and the comparative examples.

The obtained plating belt is stretched around two rolls having a diameter of 8 mm (stress applying rolls), and the plating belt is then rotated. Every 100,000 rotations, the surface of the plating belt (that is, the surface on the nickel layer side) is observed with a microscope with magnification of 100 times to check whether cracking occurs in the nickel layer, and this procedure is repeated five times. Table 1 shows the rotation number up to the occurrence of cracking (average of five times).

TABLE 1

| | | | Example 1 | Example 2 | Example 3 | Example 4 | Comparative Example 1 | Comparative Example 2 |
|---|---|---|---|---|---|---|---|---|
| Fixing member | | | 1 | 2 | 3 | 4 | C1 | C2 |
| Substrate | Thickness (μm) | | 60 | 60 | 60 | 70 | 60 | 60 |
| First metal layer | Crystal orientation | (111) | 1.20 | 1.20 | 1.30 | 1.20 | 1.20 | 1.20 |
| | | (200) | 0.90 | 0.90 | 0.80 | 0.90 | 0.90 | 0.90 |

TABLE 1-continued

| | | | Example 1 | Example 2 | Example 3 | Example 4 | Comparative Example 1 | Comparative Example 2 |
|---|---|---|---|---|---|---|---|---|
| Copper | index | (311) | 0.80 | 0.80 | 0.75 | 0.80 | 0.80 | 0.80 |
| layer | Average crystal grain size (μm) | | 1.80 | 1.80 | 2.20 | 1.80 | 1.80 | 1.80 |
| Second | Crystal | (111) | 1.10 | 1.25 | 1.10 | 1.10 | 0.60 | 1.50 |
| metal | orientation | (200) | 1.20 | 1.0 | 1.20 | 1.20 | 3.00 | 0.80 |
| layer | index | (311) | 1.00 | 0.9 | 1.00 | 1.00 | 0.40 | 1.40 |
| Nickel | Average crystal grain size (μm) | | 0.16 | 0.18 | 0.16 | 0.16 | 0.43 | 0.01 |
| layer | Thickness (μm) | | 10 | 10 | 10 | 10 | 10 | 10 |
| Warming-up operation time (second) | | | 3 | 4 | 3 | 3 | 2 | 7 |
| Bending resistance evaluation (10,000 times) | | | 350 | 320 | 300 | 330 | 150 | 400 |

As described above, it is recognized that, in the examples, as compared with the comparative examples, both of shortening of the warming-up operation time of the fixing unit and preventing the cracking of the second metal layer due to repeated bending are exhibited.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing member comprising:

a substrate layer including a resin;

a first metal layer that is provided on an outer peripheral surface of the substrate layer and includes Cu;

a second metal layer that is provided on the outer peripheral surface of the first metal layer so as to be in contact with the first metal layer, includes Ni, and has crystal orientation indexes of 0.80 to 1.30 for a (111) plane, 0.80 to 1.50 for a (200) plane, and 0.70 to 1.30 for a (311) plane; and an elastic layer that is provided on an outer peripheral surface of the second metal layer.

2. The fixing member according to claim 1, wherein the crystal orientation indexes of the second metal layer are 1.00 to 1.30 for the (111) plane, 1.00 to 1.40 for the (200) plane, and 0.80 or more and less than 1.10 for the (311) plane.

3. The fixing member according to claim 1, wherein the first metal layer has crystal orientation indexes of 1.10 to 1.40 for a (111) plane, 0.20 to 1.70 for a (200) plane, and 0.30 to 1.50 for a (311) plane.

4. The fixing member according to claim 3, wherein the crystal orientation indexes of the first metal layer are 1.10 to 1.25 for the (111) plane, 0.50 to 1.20 for the (200) plane, and 0.80 to 1.30 for the (311) plane.

5. The fixing member according to claim 1, wherein ratios (Ni/Cu) of the crystal orientation index of the second metal layer to the crystal orientation index of the first metal layer with respect to the same crystal plane are 0.57 to 1.18 for the (111) plane, 0.47 to 7.50 for the (200) plane, and 0.47 to 4.33 for the (311) plane.

6. The fixing member according to claim 1, wherein a thickness of the second metal layer is from 5 μm to 30 μm.

7. The fixing member according to claim 6, wherein the thickness of the second metal layer is from 7 μm to 15 μm.

8. The fixing member according to claim 1, wherein a thickness of the substrate layer is from 50 μm to 90 μm.

9. The fixing member according to claim 1, wherein a ratio of a thickness of the substrate layer to a thickness of the second metal layer is from 3 to 13.

10. A fixing unit comprising:

the fixing member according to claim 1;

a pressurizing member that pressurizes an outer circumferential surface of the fixing member; and an electromagnetic induction device that causes the first metal layer included in the fixing member to generate heat by electromagnetic induction, wherein a recording medium which has an unfixed toner image formed on a surface thereof is sandwiched between the fixing member and the pressurizing member to fix the toner image on the recording medium.

11. An image forming apparatus, comprising:

an image holding member;

a charging unit that charges a surface of the image holding member;

an electrostatic latent image forming unit that forms an electrostatic latent image on a charged surface of the image holding member;

a developing unit that develops the electrostatic latent image formed on the surface of the image holding member with a toner to form a toner image;

a transferring unit that transfers the toner image formed on the surface of the image holding member to a recording medium; and the fixing unit according to claim 10 that fixes the toner image on the recording medium.

* * * * *